US009909805B2

(12) United States Patent
Morgan

(10) Patent No.: US 9,909,805 B2
(45) Date of Patent: Mar. 6, 2018

(54) RAZOR DRYING DEVICE

(71) Applicant: Bob Morgan, Centennial, CO (US)

(72) Inventor: Bob Morgan, Centennial, CO (US)

( * ) Notice: Subject to any disclaimer, the term of this patent is extended or adjusted under 35 U.S.C. 154(b) by 310 days.

(21) Appl. No.: 14/829,756

(22) Filed: Aug. 19, 2015

(65) Prior Publication Data

US 2017/0051973 A1 Feb. 23, 2017

(51) Int. Cl.

| | |
|---|---|
| ***A45D 27/48*** | (2006.01) |
| ***F26B 3/02*** | (2006.01) |
| ***F26B 25/06*** | (2006.01) |
| ***A45D 27/46*** | (2006.01) |
| ***F26B 25/14*** | (2006.01) |
| ***F26B 9/06*** | (2006.01) |

(52) U.S. Cl.

CPC ..... *F26B 3/02* (2013.01); *A45D 27/46* (2013.01); *A45D 27/48* (2013.01); *F26B 9/066* (2013.01); *F26B 25/06* (2013.01); *F26B 25/14* (2013.01); *F26B 2200/00* (2013.01)

(58) Field of Classification Search

CPC .. F26B 3/02; F26B 3/283; F26B 3/343; F26B 3/04; F26B 3/14; F26B 9/066; F26B 9/003; F26B 9/006; F26B 9/06; F26B 9/00; F26B 2200/00; F26B 2210/00; F26B 5/00; F26B 25/06; F26B 25/08; F26B 25/14; F26B 25/16; A45D 27/46; A45D 27/48

USPC ..... 34/202, 90, 443, 487, 509, 511, 107

See application file for complete search history.

(56) References Cited

U.S. PATENT DOCUMENTS

| | | | | |
|---|---|---|---|---|
| 1,595,440 | A | 8/1926 | Winslow | |
| 4,480,394 | A | 11/1984 | Salas | |
| 6,085,442 | A * | 7/2000 | Erickson | A01J 11/04 34/197 |
| D433,187 | S | 10/2000 | Dettman | |
| 6,553,687 | B1 * | 4/2003 | Leamon, Jr. | A42B 3/006 34/103 |
| 6,946,624 | B1 | 9/2005 | Tomassetti | |
| 8,458,922 | B2 | 6/2013 | Parisi et al. | |
| 2008/0060671 | A1 * | 3/2008 | Ruffin | A45D 27/46 132/292 |
| 2008/0128407 | A1 | 6/2008 | Cohn | |
| 2008/0168677 | A1 | 7/2008 | Miller | |
| 2008/0210271 | A1 * | 9/2008 | Chasen | B08B 3/02 134/111 |

(Continued)

FOREIGN PATENT DOCUMENTS

| | | |
|---|---|---|
| WO | WO2011053947 | 5/2011 |

*Primary Examiner* — Kenneth Rinehart
*Assistant Examiner* — Raymond Williamson

(57) ABSTRACT

A razor drying device for drying razors includes a housing having a top, a base, a back, a front, a left side and a right side defining an interior space within the housing. A wall and a divider are coupled to and positioned within the interior space of the housing, defining respectively a compartment and a chamber. A motor, power module and a processor are coupled to and positioned in the compartment. The motor has a shaft with a terminus extending through the wall. A fan is coupled to the terminus. The power module and the processor are operationally to each other and to the motor. The chamber has a screen for a bottom. The device has a tray, removable from the housing through a complimentary opening in the front. A plurality of inlets is positioned in the back of the housing and in the wall.

19 Claims, 3 Drawing Sheets

(56) References Cited

U.S. PATENT DOCUMENTS

| | | | | |
|---|---|---|---|---|
| 2010/0243008 | A1* | 9/2010 | Schmitt | A45D 27/46<br>134/136 |
| 2011/0271551 | A1* | 11/2011 | Pearce | A61L 2/26<br>34/492 |

* cited by examiner

RAZOR DRYING DEVICE

BACKGROUND OF THE DISCLOSURE

Field of the Disclosure

The disclosure relates to drying devices and more particularly pertains to a new drying device for drying razors.

SUMMARY OF THE DISCLOSURE

An embodiment of the disclosure meets the needs presented above by generally comprising a housing having a top, a base, a back, a front, a left side and a right side defining an interior space within the housing. A wall and a divider are coupled to and positioned within the interior space of the housing, defining respectively a compartment and a chamber. A motor, power module and a processor are coupled to and positioned in the compartment. The power module and the processor are operationally coupled to each other and to the motor. The motor has a shaft extending through the wall. A fan is coupled to a terminus of the shaft. The chamber has a screen for a bottom. The device has a tray fitting a complimentary opening in the front. A plurality of inlets is positioned in the back of the housing and in the wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
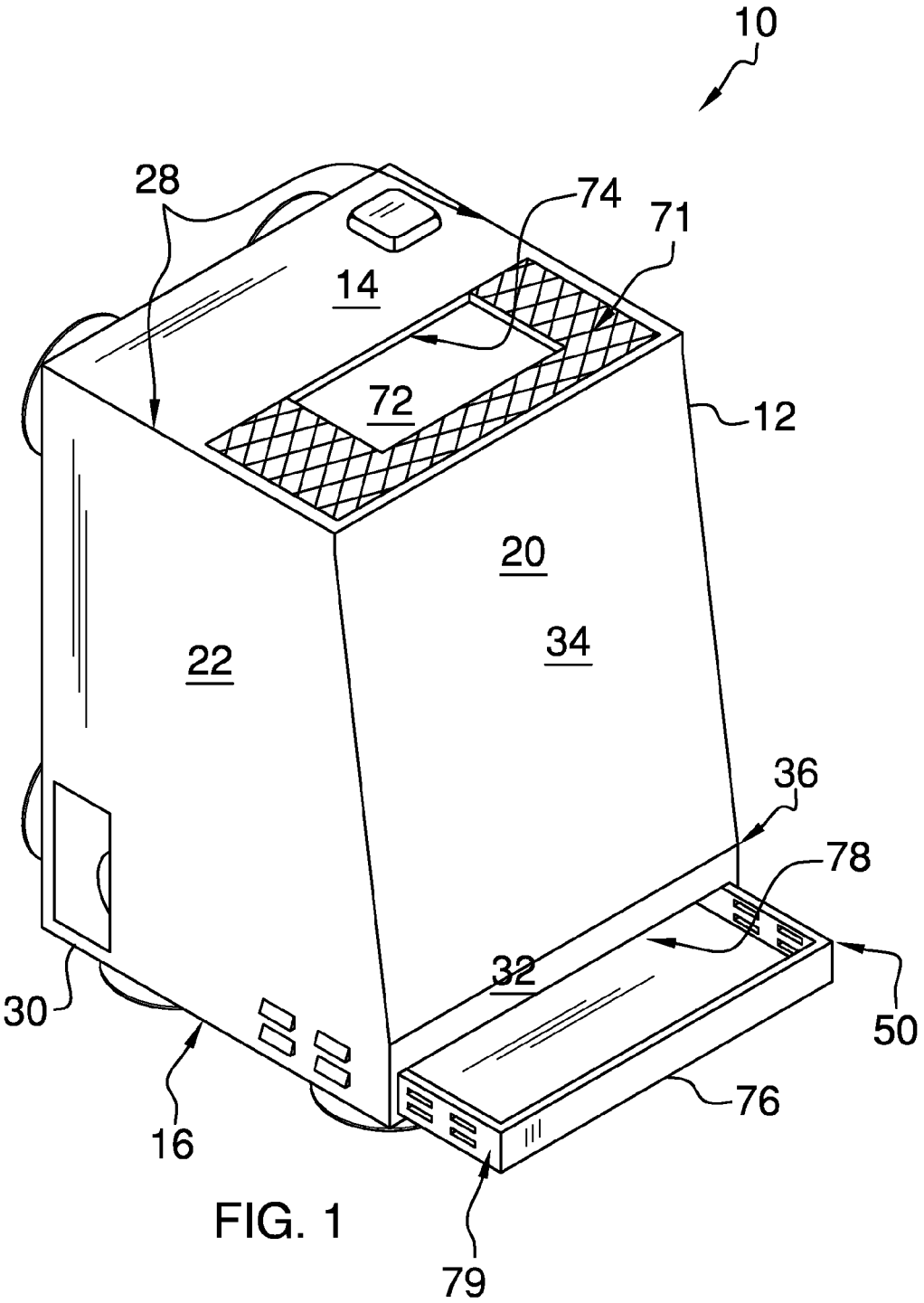
FIG. 1 is an isometric perspective view of a razor drying device according to an embodiment of the disclosure.
Figure 3:
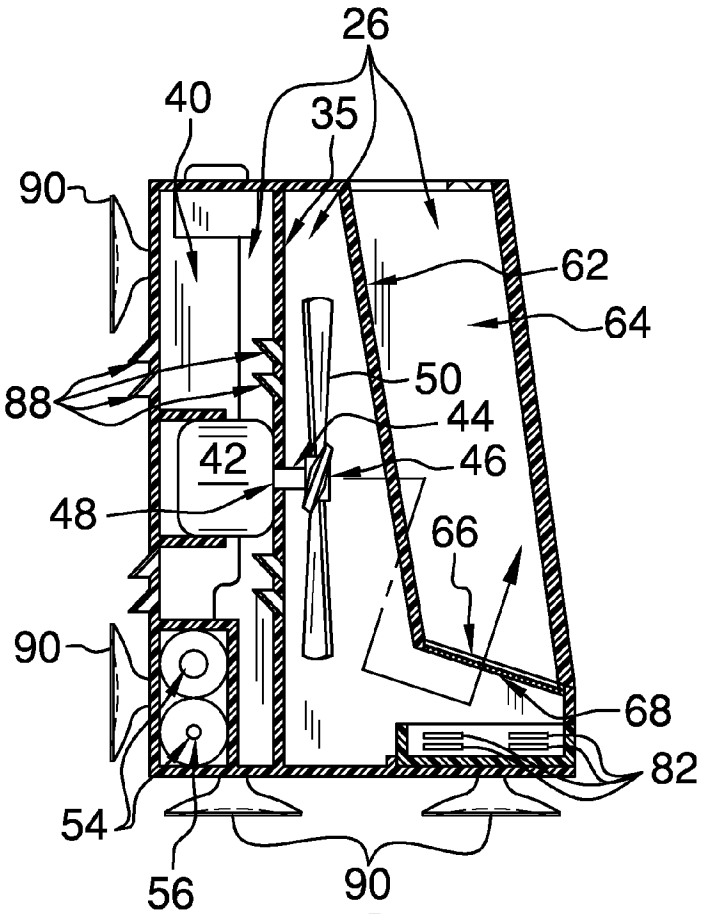
FIG. 3 is a right side cut-away view of an embodiment of the disclosure.
Figure 2:
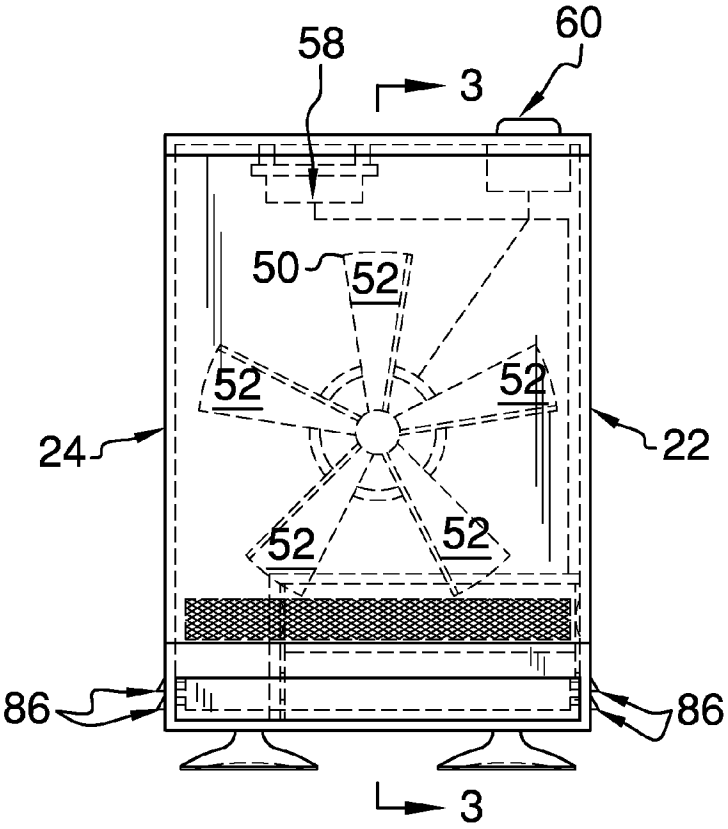
FIG. 2 is a front cut-away view of an embodiment of the disclosure.
Figure 5:
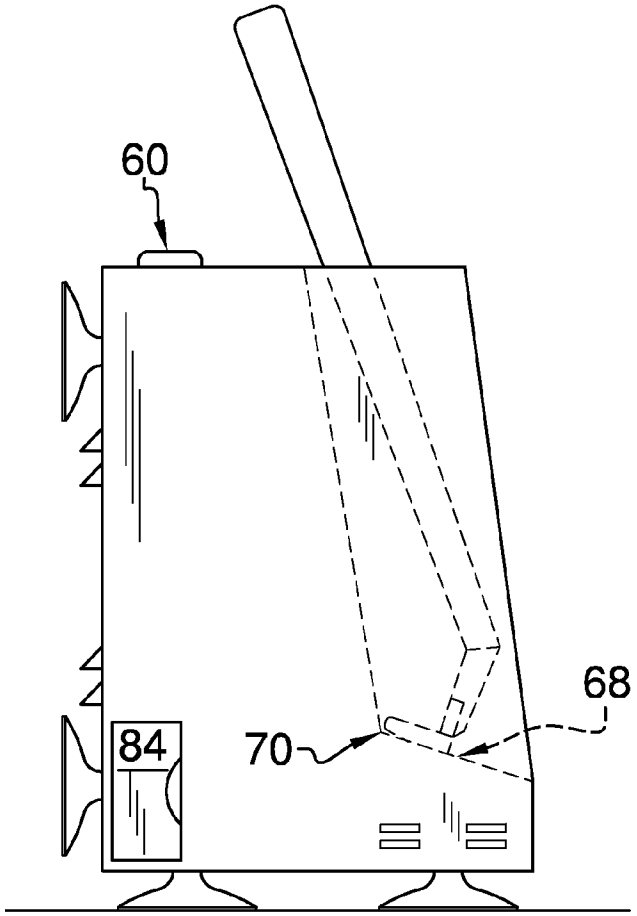
FIG. 5 is an in-use view of an embodiment of the disclosure.
Figure 4:
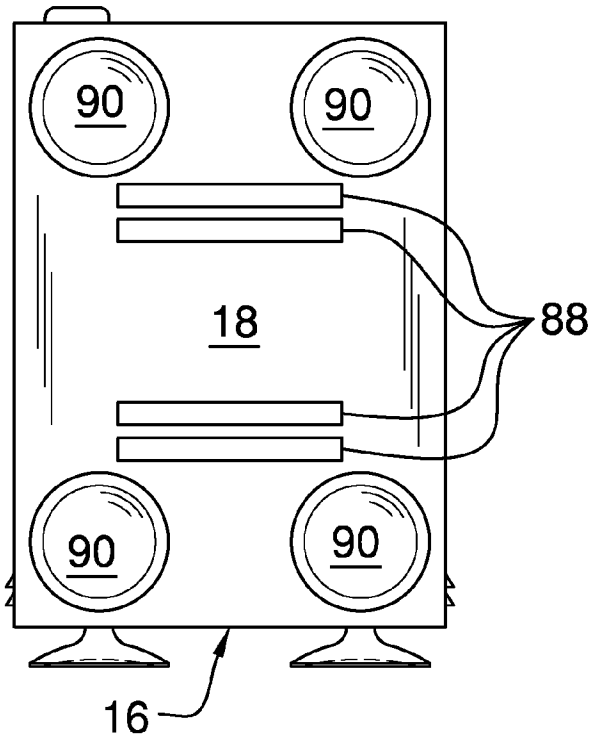
FIG. 4 is a back view of an embodiment of the disclosure.

With reference now to the drawings, and in particular to FIGS. 1 through 5 thereof, a new drying device embodying the principles and concepts of an embodiment of the disclosure and generally designated by the reference numeral 10 will be described.

As best illustrated in FIGS. 1 through 5, the razor drying device 10 generally comprises a housing 12 that has a top 14, a base 16, a back 18, a front 20, a left side 22 and a right side 24 defining an interior space 26 within the housing 12. The top 14 and the base 16 are rectangular. The top 14 has a pair of side rims 28. The base 16 has a pair of side edges 30. The side edges 30 are longer than the side rims 28. The front 20 has a lower section 32 and an upper section 34. The lower section 32 and the back 18 are in parallel planes, such that the upper section 34 recedes from the lower section 32 at an inflection line 36. A wall 38 is coupled to the housing 12. The wall 38 is positioned in the interior space 26 of the housing 12 defining a compartment 40 within the housing 12. The wall 38 and the back 18 are in parallel planes. The wall 38 extends from the top 14 to the base 16 and from the left side 22 to the right side 24. A motor 42 is coupled to and positioned in the compartment 40. The motor 42 has a shaft 44 with a terminus 46 extending through the wall 38. The terminus 46 may extend through a center 48 of the wall 38. A fan 50 is coupled to the terminus 46. The fan 50 is positioned in the interior space 26 between the wall 38 and the front 20, such that the fan 50 is configured to move air toward the front 20 of the housing 12. The fan 50 comprises of a plurality of blades 52. The plurality of blades may comprise between two and six blades. The plurality of blades may comprise between three and five blades. Preferably, the plurality of blades comprises five blades. A power module 54 is coupled to and positioned in the compartment 40. The power module 54 is operationally coupled to the motor 42. The power module 54 comprises at least one battery 56. A processor 58, operationally coupled to the power module 54 and the motor 42, is coupled to and positioned in the compartment 40. A switch 60 is positioned on the top 14 of the housing 12. The switch 60 is operationally coupled to the processor 58. The switch 60 may be positioned on the top 14 proximate to the back 18 and the right side 24. A divider 62 is coupled to the housing 12. The divider 62 is positioned in the interior space 26 of the housing 12 between the wall 38 and the front 20 defining a chamber 64 within the housing 12. The chamber 64 has a bottom 66. The bottom 66 may be a screen 68. The screen 68 extends from a bottom edge 70 of the divider 62 to the inflection line 36 and from the left side 22 to the right side 24. The chamber 64 has a cover 71, which may be serrated. The cover 71 is positioned in the top 14 proximate to the front 20. The cover 71 has a slit 72 adjacent to a rear edge 74 of the cover 71 and equally distant from the side rims 28. The divider 62 and the upper section 34 of the front 20 are in parallel planes. A tray 76, which is removable from the housing 12 through a complimentary opening 78 in the lower section 32 of the front 20, is positionable beneath the screen 68. The tray 76 has a left panel 79 and a right panel 80. There is a plurality of slots 82 positioned in the left panel 79 and the right panel 80. The plurality of slots 82 may comprise four slots positioned in the left panel 79 and four slots positioned in the right panel 80. An access panel 84 is positioned in the housing 12 proximate to the power module 54. The access panel 84 may be positioned in the left side 22 proximate to the base 16 and the back 18. A plurality of vents 86, which is soffited, is positioned in the right side 24 and the left side 22 proximate to the lower section 32 of the front 20. The plurality of vents 86 may comprise four vents positioned in the left side 22 and four vents positioned in the right side 24. Preferably, the plurality of vents 86 is aligned with the plurality of slots 82 in the tray 76. A plurality of inlets 88 is positioned in the back 18 of the housing 12 and in the wall 38. The plurality of inlets 88 is soffited and may be rectangular in shape. The plurality of inlets 88 may comprise four inlets positioned in the back 18 and aligned with four inlets positioned in the wall 38. A plurality of suction cups 90 is coupled to the back 18 and the base 16.

The plurality of suction cups 90 may comprise four suction cups coupled to the back 18 and four suction cups coupled to the base 16.

In use, the slit 72 of the cover 71 is configured to allow insertion of a razor into the chamber 64 with the blade end of the razor resting upon the screen 68 and the handle of the razor protruding through the slit 72. The switch 60 is configured to be engaged, signaling the processor 58 to allow power from the power module 54 to the motor 42, which turns the fan 50. The fan 50 pulls air through the plurality of inlets 88, pushing the air through the screen 68, over the blades of the razor, and out the cover 71, effectively drying the blades of the razor.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A razor drying device comprising:

a housing, said housing having a top, a base, a back, a front, a left side and a right side defining an interior space within said housing;

a wall being coupled to said housing, said wall being positioned in said interior space of said housing defining a compartment within said housing;

a motor, said motor being coupled to and positioned in said compartment, said motor having a shaft, said shaft having a terminus, said terminus extending through said wall;

a fan, said fan being coupled to said terminus;

a power module, said power module being coupled to and positioned in said compartment, said power module being operationally coupled to said motor;

a processor, said processor being coupled to and positioned in said compartment; said processor being operationally coupled to said power module and said motor;

a divider being coupled to said housing, said divider being positioned in said interior space of said housing between said wall and said front defining a chamber within said housing, said chamber having a bottom, said bottom being a screen, said chamber having a cover;

a tray, said tray being removable from said housing through a complimentary opening in said front, wherein said tray is positionable beneath said screen; and a plurality of inlets, said plurality of inlets being positioned in said back of said housing and in said wall, said inlets being soffited and rectangular in shape.

2. The device of claim 1, further including said top and said base being rectangular.

3. The device of claim 2, further comprising:

said top having a pair of side rims;

said base having a pair of side edges; and said side edges being longer than said side rims.

4. The device of claim 1, further including said terminus extending through a center of said wall.

5. The device of claim 1, further including said fan being comprised of a plurality of blades.

6. The device of claim 5, further including said plurality of blades comprising between two and six blades.

7. The device of claim 6, further including said plurality of blades comprising between three and five blades.

8. The device of claim 7, further including said plurality of blades comprising five blades.

9. The device of claim 1, further including said power module comprising at least one battery.

10. The device of claim 1, further including a switch, said switch being positioned on said top of said housing, said switch being operationally coupled to said processor.

11. The device of claim 10, further including said switch being positioned on said top proximate to said back and said right side.

12. The device of claim 1, further comprising:

said cover being positioned in said top proximate to said front;

said cover having a slit, said slit being positioned in said cover adjacent to a rear edge of said cover, said slit being positioned equally distant from said side rims.

13. The device of claim 1, further including an access panel, said access panel being positioned in said housing proximate to said power module.

14. The device of claim 1, further including said plurality of inlets comprising four inlets positioned in said back aligned with four inlets positioned in said wall.

15. A razor drying device comprising:

a housing, said housing having a top, a base, a back, a front, a left side and a right side defining an interior space within said housing;

a wall being coupled to said housing, said wall being positioned in said interior space of said housing defining a compartment within said housing;

a motor, said motor being coupled to and positioned in said compartment, said motor having a shaft, said shaft having a terminus, said terminus extending through said wall;

a fan, said fan being coupled to said terminus;

a power module, said power module being coupled to and positioned in said compartment, said power module being operationally coupled to said motor;

a processor, said processor being coupled to and positioned in said compartment; said processor being operationally coupled to said power module and said motor;

a divider being coupled to said housing, said divider being positioned in said interior space of said housing between said wall and said front defining a chamber within said housing, said chamber having a bottom, said bottom being a screen, said chamber having a cover;

a tray, said tray being removable from said housing through a complimentary opening in said front, wherein said tray is positionable beneath said screen;

a plurality of inlets, said plurality of inlets being positioned in said back of said housing and in said wall;

said tray having a left panel and a right panel;

said tray having a plurality of slots positioned in said left panel and said right panel;

a plurality of vents, said vents being soffited; and said plurality of vents being positioned in said right side and said left side proximate to said lower section of said front, wherein said plurality of vents align with said plurality of slots in said tray when said tray is positioned under said screen.

16. The device of claim 15, further comprising:

said plurality of slots comprising four slots positioned in said left panel and four slots positioned in said right panel; and said plurality of vents comprising four vents positioned in said left side and four vents positioned in said right side.

17. A razor drying device comprising:

a housing, said housing having a top, a base, a back, a front, a left side and a right side defining an interior space within said housing, said top and said base each being rectangular, said top having a pair of side rims, said base having a pair of side edges, said side edges being longer than said side rims;

a wall being coupled to said housing, said wall being positioned in said interior space of said housing defining a compartment within said housing;

a motor, said motor being coupled to and positioned in said compartment, said motor having a shaft, said shaft having a terminus, said terminus extending through said wall;

a fan, said fan being coupled to said terminus;

a power module, said power module being coupled to and positioned in said compartment, said power module being operationally coupled to said motor;

a processor, said processor being coupled to and positioned in said compartment;

said processor being operationally coupled to said power module and said motor;

a divider being coupled to said housing, said divider being positioned in said interior space of said housing between said wall and said front defining a chamber within said housing, said chamber having a bottom, said bottom being a screen, said chamber having a cover;

a tray, said tray being removable from said housing through a complimentary opening in said front, wherein said tray is positionable beneath said screen;

a plurality of inlets, said plurality of inlets being positioned in said back of said housing and in said wall;

said front having a lower section and an upper section;

said lower section and said back being in parallel planes, wherein said upper section recedes from said lower section at an inflection line;

said divider and said upper section of said front being in parallel planes;

said wall and said back being in parallel planes;

said wall extending from said top to said base and from said left side to said right side; and said screen extending from a bottom edge of said divider to said inflection line and from said left side to said right side.

18. A razor drying device comprising:

a housing, said housing having a top, a base, a back, a front, a left side and a right side defining an interior space within said housing;

a wall being coupled to said housing, said wall being positioned in said interior space of said housing defining a compartment within said housing;

a motor, said motor being coupled to and positioned in said compartment, said motor having a shaft, said shaft having a terminus, said terminus extending through said wall;

a fan, said fan being coupled to said terminus;

a power module, said power module being coupled to and positioned in said compartment, said power module being operationally coupled to said motor;

a processor, said processor being coupled to and positioned in said compartment; said processor being operationally coupled to said power module and said motor;

a divider being coupled to said housing, said divider being positioned in said interior space of said housing between said wall and said front defining a chamber within said housing, said chamber having a bottom, said bottom being a screen, said chamber having a cover;

a tray, said tray being removable from said housing through a complimentary opening in said front, wherein said tray is positionable beneath said screen;

a plurality of inlets, said plurality of inlets being positioned in said back of said housing and in said wall; and an access panel, said access panel being positioned in said housing proximate to said power module, said access panel being positioned in said left side proximate to said base and said back.

19. A razor drying device comprising:

a housing, said housing having a top, a base, a back, a front, a left side and a right side defining an interior space within said housing, said top and said base being rectangular, said top having a pair of side rims, said base having a pair of side edges, said side edges being longer than said side rims, said front having a lower section and an upper section, said lower section and said back being in parallel planes, wherein said upper section recedes from said lower section at an inflection line;

a wall being coupled to said housing, said wall being positioned in said interior space of said housing defining a compartment within said housing, said wall and said back being in parallel planes, said wall extending from said top to said base and from said left side to said right side;

a motor, said motor being coupled to and positioned in said compartment, said motor having a shaft, said shaft having a terminus, said terminus extending through said wall, said terminus extending through a center of said wall;

a fan, said fan being coupled to said terminus, said fan being positioned in said interior space between said wall and said front, wherein said fan is configured to move air toward said front of said housing, said fan being comprised of a plurality of blades, said plurality of blades comprising between two and six blades, said plurality of blades comprising between three and five blades, said plurality of blades comprising five blades;

a power module, said power module being coupled to and positioned in said compartment, said power module being operationally coupled to said motor, said power module comprising at least one battery;

a processor, said processor being coupled to and positioned in said compartment; said processor being operationally coupled to said power module and said motor;

a switch, said switch being positioned on said top of said housing, said switch being operationally coupled to said processor, said switch being positioned on said top proximate to said back and said right side;

a divider being coupled to said housing, said divider being positioned in said interior space of said housing between said wall and said front defining a chamber within said housing, said chamber having a bottom, said bottom being a screen, said screen extending from a bottom edge of said divider to said inflection line and from said left side to said right side, said chamber having a cover, said cover being positioned in said top proximate to said front, said cover having a slit, said slit being positioned in said cover adjacent to a rear edge of said cover, said slit being positioned equally distant from said side rims, said divider and said upper section of said front being in parallel planes;

a tray, said tray being removable from said housing through a complimentary opening in said lower section of said front, wherein said tray is positionable beneath said screen, said tray having a left panel and a right panel, said tray having a plurality of slots positioned in said left panel and said right panel, said plurality of slots comprising four slots positioned in said left panel and four slots positioned in said right panel;

an access panel, said access panel being positioned in said housing proximate to said power module, said access panel being positioned in said left side proximate to said base and said back;

a plurality of vents, said vents being soffited, said plurality of vents being positioned in said right side and said left side proximate to said lower section of said front, said plurality of vents comprising four vents positioned in said left side and four vents positioned in said right side, said plurality of vents being aligned with said plurality of slots in said tray;

a plurality of inlets, said plurality of inlets being positioned in said back of said housing and in said wall, said inlets being soffited and rectangular in shape, said plurality of inlets comprising four inlets positioned in said back aligned with four inlets positioned in said wall; and a plurality of suction cups, said plurality of suction cups being coupled to said back and said base, said plurality of suction cups comprising four suction cups coupled to said back and four suction cups coupled to said base, wherein said slit of said cover is configured for insertion of a razor into said chamber with the blade end of the razor resting upon said screen and the handle of the razor protruding through said slit, and wherein said switch is configured to be engaged, signaling said processor to allow power from said power module to said motor to turn said fan, pulling air through said plurality of inlets and forcing the air through said screen, over the blades of the razor, and out said cover, effectively drying the blades of the razor.

* * * * *